US005671642A

United States Patent [19]

Haas

[11] Patent Number: 5,671,642

[45] Date of Patent: Sep. 30, 1997

[54] CENTERING MECHANISM FOR A FASTENER DRIVING DEVICE

[75] Inventor: Guenter Haas, Nuertingen, Germany

[73] Assignee: Karl M. Reich Maschinenfabrik GmbH, Nuertingen, Germany

[21] Appl. No.: 493,671

[22] Filed: Jun. 22, 1995

[30] Foreign Application Priority Data

Jun. 29, 1994 [DE] Germany ..... 44 22 725.6

[51] Int. Cl.[6] ..... B25B 23/10

[52] U.S. Cl. ..... 81/57.37; 81/454

[58] Field of Search ..... 81/44, 487, 57.37, 81/433–435, 451–458, 184

[56] References Cited

U.S. PATENT DOCUMENTS

| | | | |
|---|---|---|---|
| 1,977,323 | 10/1934 | Morgan | 81/458 |
| 3,178,971 | 4/1965 | Bachli et al. | 81/456 X |
| 3,547,169 | 12/1970 | Bangerter | 81/454 X |
| 3,730,237 | 5/1973 | Hanzlik | 81/456 |
| 4,862,774 | 9/1989 | Else et al. | 81/454 X |
| 5,088,359 | 2/1992 | Hockman | 81/454 X |
| 5,186,084 | 2/1993 | Totsu | 81/57.37 X |

FOREIGN PATENT DOCUMENTS

| | | | |
|---|---|---|---|
| 1403402 | 10/1968 | Germany | 81/57.37 |
| 1923712 | 11/1970 | Germany . | |

*Primary Examiner*—D. S. Meislin
*Attorney, Agent, or Firm*—W. G. Fasse; W. F. Fasse

[57] ABSTRACT

A driving device for driving a fastener (2) includes a centering mechanism (9) for centering and guiding the fastener (2). The centering mechanism includes centering elements (10, 26, 36, 37) that are tiltably or slidably connected to a mounting body (3) to be movable in directions tangential to the fastener. The centering elements (10) have contact surfaces (19) for contacting the fastener (2) that are each substantially parallel to the direction of motion of the respective centering element (10). In this manner, the centering elements (10) cannot be deflected radially away from the fastener, and any forces applied laterally outwardly by the fastener against the contact surfaces (19) are rigidly received and resisted by the centering elements (10) and the mounting body (3) in which they are held.

23 Claims, 4 Drawing Sheets

CENTERING MECHANISM FOR A FASTENER DRIVING DEVICE

FIELD OF THE INVENTION

The invention relates to a driving device for driving screws, nails, rivets, pins and the like, which are generally called fasteners herein. The driving device includes a centering mechanism with centering elements that are laterally movable and elastically urged into contact with the fastener.

BACKGROUND INFORMATION

German Patent Publication 1,923,712 A1 describes a driving device for screws, having a centering mechanism for the screws including centering elements in the form of holding jaws tiltably arranged on a bearing or mounting body. The jaws have contact surfaces for holding the screws, and the contact surfaces extend perpendicularly or inclined at an angle relative to the respective plane of the tilting motion of the centering element. Centering mechanisms of that type, in which the contact surfaces of the centering jaws are perpendicular or inclined at an angle relative to the tilting plane of the centering jaws, are also known in driving devices for nails, pins and other fasteners.

In the known centering mechanisms, the centering elements can yield, i.e. they can be deflected, away from the fastener when a lateral force acts on the fastener. As a result, the fastener is not securely held and guided while it is being screwed or impact driven. Thus, under certain circumstances, the fastener will be driven into the workpiece at an angle, which is especially undesirable in the construction of furniture and in other fine carpentry and cabinetry.

OBJECTS OF THE INVENTION

In view of the above it is the aim of the invention to achieve the following objects singly or in combination:

- to provide a fastener driving device having a centering mechanism for the fasteners, which is able to securely hold and guide the fasteners during the driving process;
- to provide a centering mechanism for such a driving device in which the centering elements cannot be deflected radially outwardly by a radially outward force applied by the fastener;
- to provide a centering mechanism for such a driving device in which the fastener contact surfaces of the centering elements extend substantially parallel to the plane of motion of the centering elements and especially extend perpendicularly to the respective tilting axis of the centering element;
- to provide a centering mechanism for such a driving device in which the centering elements remain in place to guide the fastener until the head of the fastener tiltingly deflects the centering elements away from the fastener;
- to provide radially inwardly protruding ribs on the centering elements of such a centering mechanism, which ribs engage the threading of a screw being driven so as to enforce an axial advance motion as the screw is being driven;
- to provide a centering mechanism that is applicable to stationary as well as handheld driving devices; and
- to provide a centering mechanism that can be radially adjusted to fasteners having different diameters.

SUMMARY OF THE INVENTION

The above objects have been achieved in a driving device having a centering mechanism according to the invention, including a mounting or bearing body connected to a motor housing and a centering mechanism for the fasteners connected to the bearing body. Centering elements of the centering mechanism are connected to the bearing body to be laterally movable relative to the fastener, while the centering elements are elastically urged into guiding and centering contact with the fastener. The respective contact surfaces of the centering elements that cooperate with the fastener are arranged to extend substantially parallel to the direction of motion of the respective centering element. More particularly, each centering element is tiltable about a tilting axis and the contact surfaces are substantially perpendicular to the tilting axes, or each centering element is slidable and the contact surfaces are substantially parallel to the direction of sliding.

Due to the particular arrangement of the contact surfaces, all lateral forces that may affect the fastener are transmitted substantially perpendicularly to the contact surfaces of one or more of the centering elements and then rigidly transmitted to and taken up by the bearing of the respective centering element.

It is impossible for the centering element to yield or be deflected away by the fastener during the driving process. Thus, the shaft of the fastener is securely held and guided straight into the workpiece. Thereby, it can always be ensured that the fastener is driven into the workpiece in the desired direction without any problems. The centering elements are only tilted away from the fastener once the head of the screw, which has a larger diameter than the screw shaft, presses the centering elements laterally apart, or when the impact driver head of a nail driver device pushes the centering elements laterally apart.

The invention may especially advantageously be applied to screw driving devices in which the motor housing and the motor-driven screw driving bit are axially slidably arranged, against a spring bias, relative to a mounting body on which the centering elements are mounted. In such an embodiment, the mounting body can simultaneously serve as a contact foot or sole plate of the driving device.

According to a further detail of the invention, the contact surfaces of the centering elements are provided with ribs that protrude radially inwardly from the contact surface and extend substantially perpendicularly to the driving direction. When a screw is being driven, the threads of the screw engage the ribs, so that the screw pulls itself axially through the centering mechanism, that is to say the screw pulls the mounting body against the spring arranged between the mounting body and the motor housing, so that the operator of the device need not apply the force necessary for compressing the spring.

The above described feature is especially advantageous when gypsum wallboard, for example known as sheet-rock, is to be screwed onto wooden or steel studs and the like. Typically, the screws do not positively engage the wallboard, and the positive axial screwing advance of the screw only begins once the screw reaches the underlying workpiece made of wood or steel. If successive screws to be fed into the driving device are connected together by a plastic strip in the usual manner, then it can occur that the screw head comes into contact with the screw connector strip before the screw has been driven through the wallboard and positively engaged the wood or steel. In this case, the positive axial advance achieved by the screw engaging the ribs ensures that the screw is smoothly pulled out of the connector strip without requiring any extra force to be applied.

In order that the centering elements are tilted out of the way by the screw head as described above, the centering elements include inclined ramp surfaces adapted to be contacted by the screw head. Preferably, the inclined ramp surfaces of two centering elements are arranged one before another in the driving direction so that the first centering element is tilted away before the second centering element. In this manner, the two centering elements can have mutually engaging or intertwining contact jaws, whereby the contact jaw of the first centering element is tilted away first and thereby releases the contact jaw of the second centering element, which is then tilted away.

The invention can be applied to compressed air nailing devices, wherein the mounting body is rigidly attached to the motor housing, i.e. a cylinder-piston unit. Thus, only the impact driver rod is movable relative to the contact foot or shoe.

It should be understood that the invention can be applied to stationary driving devices as well as handheld or portable driving devices.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
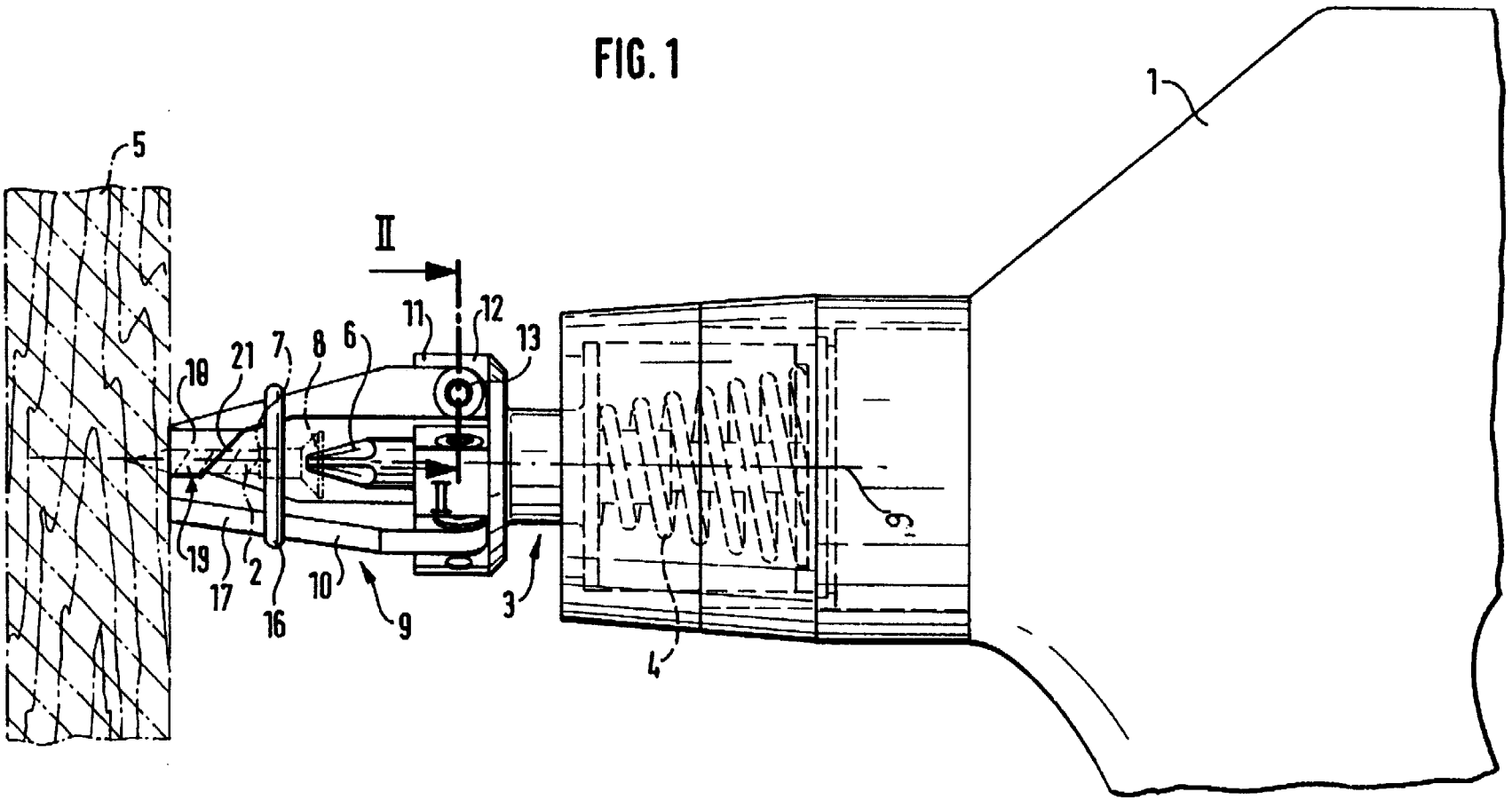
FIG. 1 is a side view of part of a driving device according to the invention, showing a first embodiment of a centering mechanism.

As shown in FIG. 1, a driving device includes a motor housing 1, which houses a motor (not shown) that drives a screw driving blade or bit 6 for driving a fastener 2, in this case a screw 2 for example, into a workpiece B. Alternatively, the driving bit may be an impact driver rod, a riveting head, or the like. A driving axis 6' extends axially through the bit 6, and optimally also through the fastener 2, and defines a driving direction in which the fastener 2 is driven. A bearing or mounting body 3 is axially slidably connected to the motor housing 1, and a spring 4 is interposed between the mounting body 3 and the housing 1 to bias the axial sliding motion of the mounting body 3 relative to the housing 1. The fastener 2 comprises a shaft 7 and a head 8 that has a larger diameter than the shaft 7.

In order to hold and guide the fastener 2 before and during the driving process, the driving device according to the invention includes a centering mechanism 9, which comprises three identical centering elements 10 which are each tiltably connected to the mounting body 3. In order to achieve the swinging or tilting connection of the centering elements 10, the mounting body 3 includes a mounting ring 11, which in turn comprises mounting blocks 12 as shown especially in FIG. 2. These mounting blocks 12 have respective threaded holes 13 provided therein. A respective threaded bolt 14 is screwed into each threaded hole 13 and includes a protruding axis stud 15 on which a respective one of the centering elements 10 is mounted. An elastic ring spring or circular spring 16 encircles all three centering elements 10 and presses the centering elements generally inwardly toward the fastener 2.

A respective leg 17 of each centering element 10 extends generally in the driving direction away from the end of the centering element 10 that is tiltably mounted on the respective protruding axis stud 15. A respective contact jaw 18 is arranged perpendicularly to the leg 17 at the free end thereof. Each contact jaw 18 includes a respective contact surface 19 that faces the fastener 2 and that is substantially perpendicular to the axis 20—20 of the corresponding protruding stud 15 as shown especially in FIG. 2. Thus, the contact surface 19 of each centering element 10 is substantially parallel to the plane of the tilting motion of the centering element 10 about the axis 20—20 of the protruding stud 15. As a result, any lateral or radial forces effective on the fastener 2 are transmitted into and firmly resisted by one or more of the centering elements 10, without yielding or deflecting in a radially outward direction relative to the fastener 2.

Thus, the centering elements 10 are tiltable or swingable in planes parallel to the driving axis 6' and tangential to a circle centered on the driving axis 6', and the contact surfaces 19 are parallel to those tilting planes. Therefore, the centering elements 10 cannot yield radially away from the fastener 2, but instead can only tilt in directions tangential to the circumference of the fastener 2 and respectively about the corresponding axis 20—20 of the protruding axis stud 15. More particularly, the centering elements 10 will be urged to swing laterally away from the fastener 2 only when this is caused by the larger diameter head 8 of the fastener 2 as described next.

As shown in FIG. 1, contact jaw 18 includes a jaw-spreading or tilt-actuating ramp surface 21, and the other centering elements include corresponding ramp surfaces, for causing a tilting motion of each centering element 10 when the fastener head 8 comes into contact with the ramp surfaces 21. The contact jaw 18 further includes a lead-in ramp surface 22, which facilitates feeding the fastener laterally into the proper position between the contact jaws 18, as shown especially in FIG. 2 i.e. the lead-in ramp surfaces 22 guide a fastener 2 that is being fed laterally into the driving position and cause the respective centering element 10 to swing out of the way.

Figure 2:
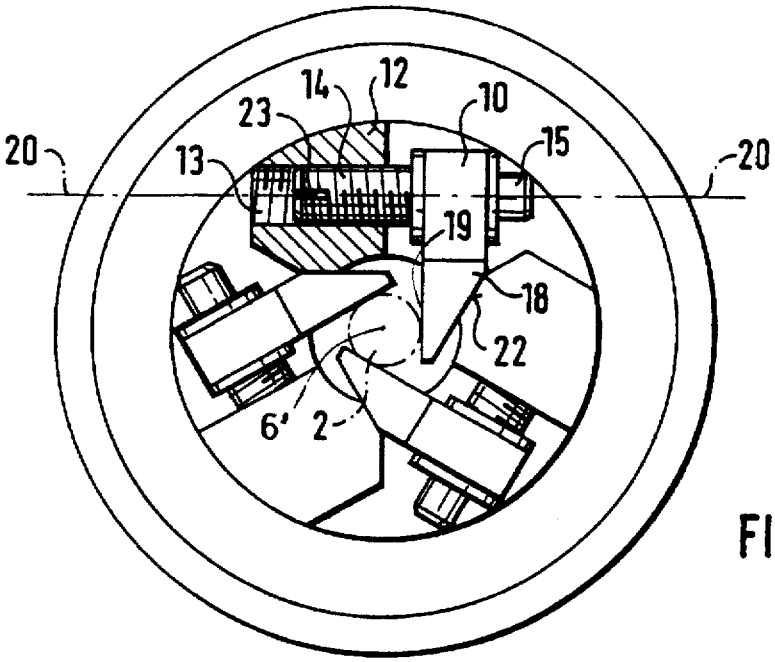
FIG. 2 is a view of the tool of FIG. 1, taken from the contact side, i.e. the workpiece side, and partially in section along the section line II—II of FIG. 1.

FIG. 2 further shows that the threaded holes 13 that receive the threaded bolts 14 are arranged in the form of an equilateral triangle in the mounting ring 11. Correspondingly, the contact surfaces 19 of the three centering elements 10 also form an equilateral triangle to provide a symmetrical and stable guiding and holding of the fastener 2. Each threaded bolt 14 has a slot 23 to enable each bolt 14 to be turned with a screwdriver in order to adjust the position of the centering element perpendicularly relative to its tilting plane, that is to say, radially toward or away from the fastener 2, so as to adjust the space between the contact surfaces 19 to fit the diameter of the shaft 7 of different fasteners 2.

Figure 3:
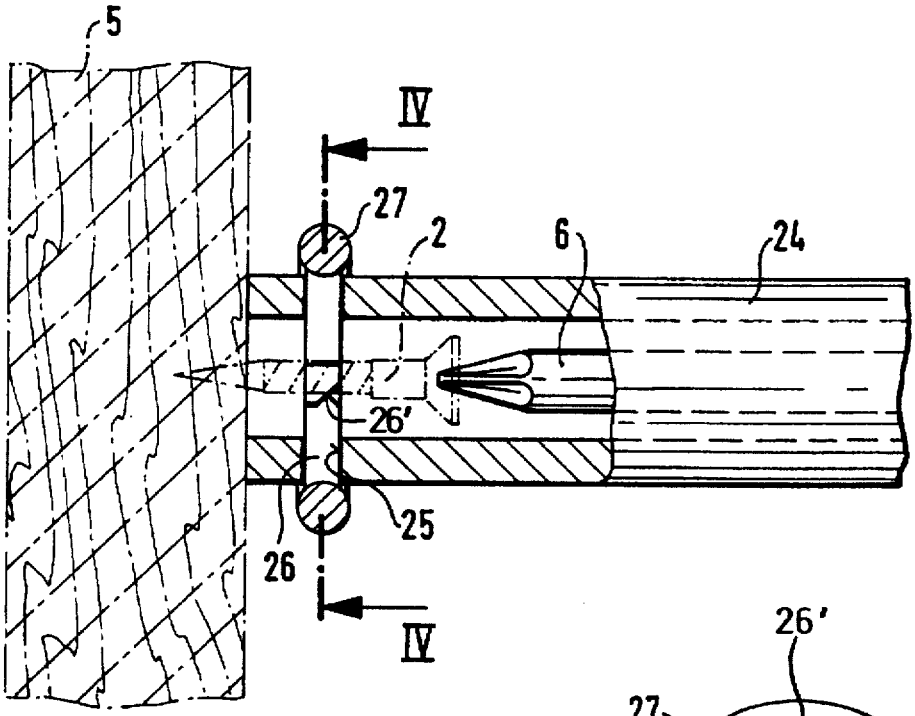
FIG. 3 is a partial lengthwise section through another example embodiment of a driving device according to the invention.
Figure 4:
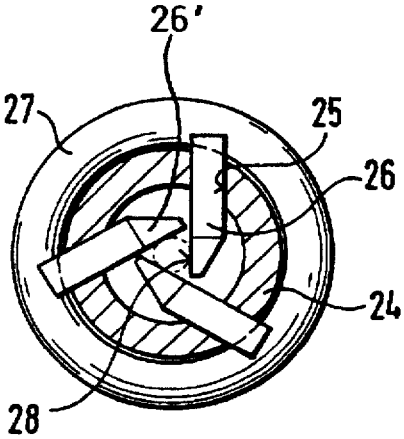
FIG. 4 is a sectional view along the line IV—IV of FIG. 3.

FIGS. 3 and 4 show another example embodiment of the driving device according to the invention, in which a mounting body 24 is constructed to simultaneously serve as a contact foot which may be placed against the workpiece 5. As described above for the first example embodiment, a screw driving bit 6 serves to drive a fastener 2 such as a screw. Slots 25 are provided in the mounting body 24 to extend outwardly through the mounting body 24 in a pinwheel-like configuration as shown especially in FIG. 4. Three centering elements 26 are respectively slidably arranged in the three slots 25. A ring spring or circular spring 27 encircles the mounting body 24 at the area of the centering elements 26 so as to urge the centering elements 26 laterally inwardly, in directions corresponding to the pinwheel-shaped arrangement of the slots 25.

Each centering element 26 has a contact surface 28 that extends substantially parallel to the plane of the sliding motion of the respective centering element 26. Thus, it is impossible for the centering elements 26 to yield or be deflected radially outwardly by a lateral force applied to the contact surface 28 by the fastener 2. When the larger head 8 comes into contact with the centering elements 26, that is to say when the head 8 is driven through the space between the centering elements 26, the centering elements are pushed back against the tension of the circular spring 27 to allow the fastener head 8 to pass through. For this reason, each centering element 26 may include a ramp surface 26'.

In order to accommodate different diameters of fasteners 2, it is possible to exchange the mounting body 24 with a different mounting body to provide a different spacing between the centering elements 26.

Figure 5:
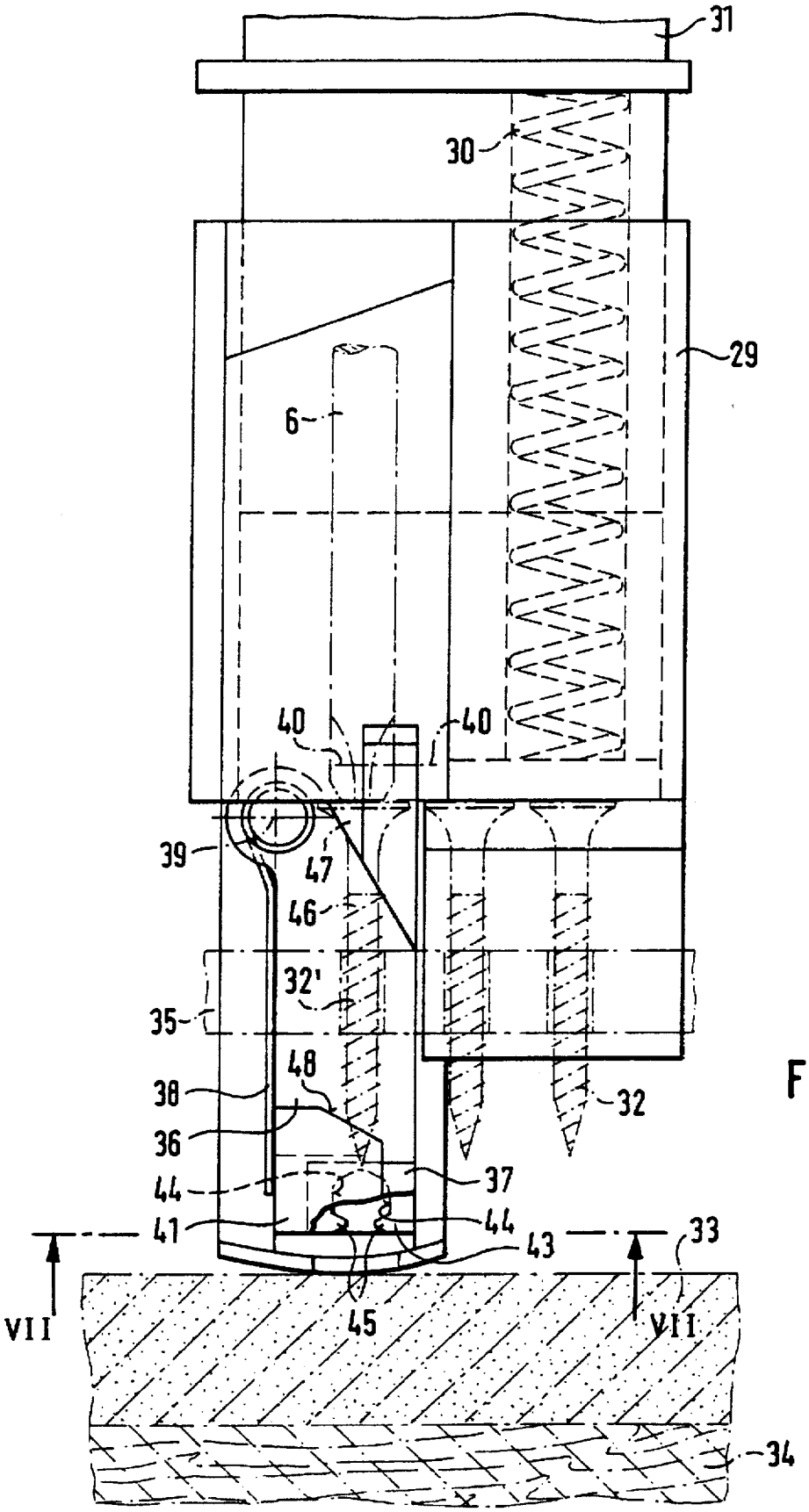
FIG. 5 a side view of another example embodiment of driving device according to the invention, in a resting or idle state.
Figure 6:
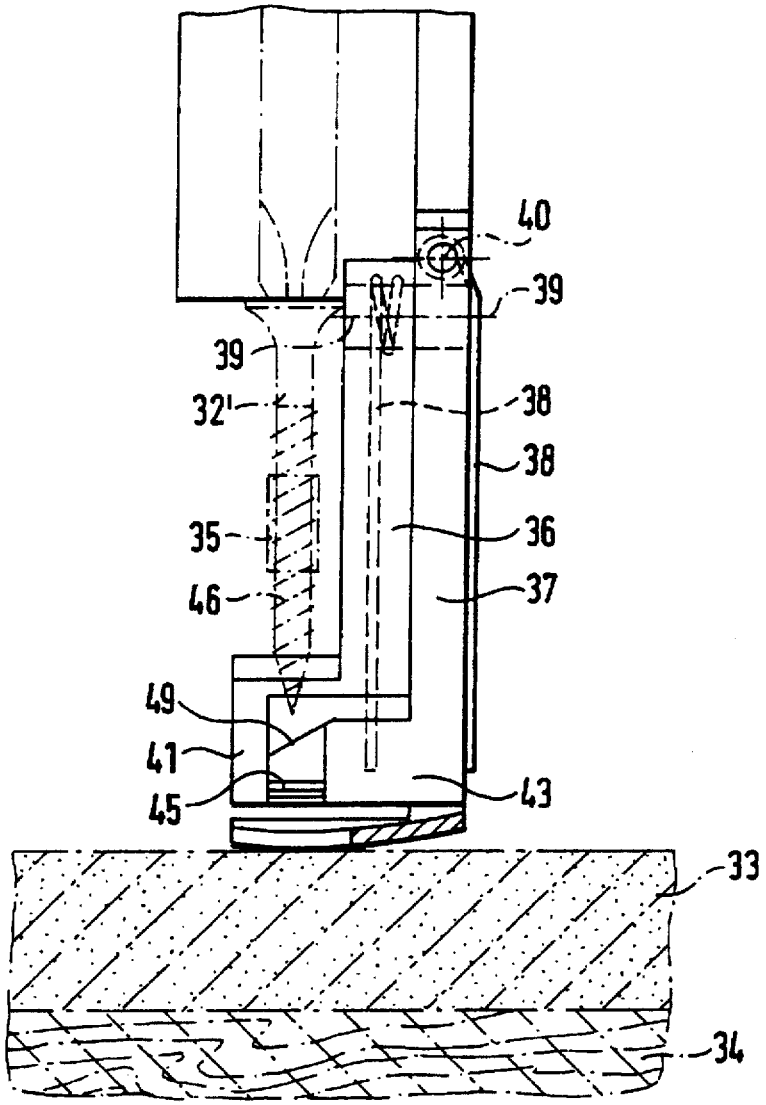
FIG. 6 is a view of the driving device of FIG. 5 taken from the feed-in side; end
Figure 7:
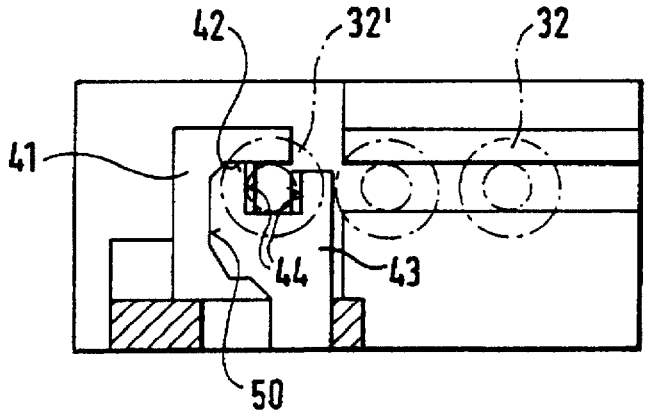
FIG. 7 is a sectional view along the line VII—VII of FIG. 5.

FIGS. 5 to 7 show a third example embodiment of a fastener driving device according to the invention, wherein a mounting body 29 is slidably connected to a motor housing 31 under the effect of a biasing spring 30. A screw driving bit 6 is driven by a motor (not shown) to move axially together with the motor housing 31, but rotate freely relative thereto. The screw driving bit 6 drives a first screw 32', which is to secure a gypsum or sheet-rock panel 33 onto a workpiece 34 made of wood or steel and arranged behind the sheet-rock panel 33. The first screw 32' and a plurality of successive screws 32 are interconnected by a plastic connector belt or strip 35 in a generally known manner. As each screw is driven into the workpiece, it is pulled free from the connector strip 35.

The apparatus according to this embodiment of the invention includes two centering elements 36 and 37 to hold and guide the screws 32'. Each centering element 36 and 37 is tiltably connected to the mounting body 29 to tilt about a respective one of two mutually perpendicular tilting axes 39—39 and 40—40, under the biasing effect of respective leg springs 38. The centering element 36 includes a contact jaw 41 having at least one contact surface 42, which is parallel to the tilting plane of centering element 36, as shown especially in FIG. 7. The centering element 37 includes a contact jaw 43 having two opposite contact surfaces 44, which are parallel to the tilting plane of the centering element 37.

As shown especially by FIGS. 5 and 6, the contact jaw 43 comprises ribs 45 extending substantially perpendicularly to the driving direction and protruding radially inwardly from the contact surfaces 44. When the screw 32' is being driven, the threads 46 of the screw 32' engage the ribs 45. In this manner, a positive axial feed advance is imposed on the rotating screw, which actively pulls itself axially through the space between the contact surfaces 44 and 42 because of the screw threads 46 engaging the ribs 45. As a result, on the one hand the mounting body 29 is pulled against the biasing effect of the spring 30 against the motor housing 31, and on the other hand the head 47 of the screw 32' is pulled free from the connector strip 35 once the head 47 reaches the strip 35.

As shown in FIG. 7, the contact jaw 41 includes a pocket 50. The contact jaw 43 has a corresponding shape to be able to reach into or engage the pocket 50 of the contact jaw 41 in a resting state. The contact jaw 41 has a ramp surface 48 which causes the tilting motion of the contact jaw 41 once the screw head 47 contacts the ramp surface 48. The contact jaw 43 similarly includes a ramp surface 49. When viewed in the driving direction, the ramp surface 48 of the contact jaw 41 is arranged before the ramp surface 49 of the contact jaw 43. Thus, during the screw driving process, the screw head 47 first contacts the ramp surface 48 so as to tilt the contact jaw 41 laterally away from the screw 32', thereby releasing the contact jaw 43. Thereafter, the screw head 47 contacts the ramp surface 49 so as to tilt away the contact jaw 43. In this manner, the screw 32' is securely held and guided by the contact jaws 41 and 43 until the screw has reached the solid wood or steel of the workpiece 34. In this manner, the screw 32' is securely held against tipping in the sheet-rock panel 33, and the screw does not rely on a screwing grip in the sheet-rock material.

Although the invention has been described with reference to specific example embodiments, it will be appreciated that it is intended to cover all modifications and equivalents within the scope of the appended claims.

What is claimed is:

1. A driving device for centeringly holding and driving a fastener, comprising a housing, a mounting body connected to said housing, a plurality of centering elements that are adapted to centeringly hold said fastener during driving thereof, and that are connected to said mounting body to be respectively independently movable relative to said fastener in respective plural lateral directions and to be rotationally fixed relative to said mounting body and with said fastener rotatable relative to said centering elements, and at least one elastic element urging said centering elements toward respective positions to contact said fastener, wherein each respective one of said centering elements comprises a respective contact surface adapted to contact said fastener and arranged substantially parallel to said respective lateral direction of motion of said respective one of said centering elements, and wherein at least one of said centering elements further comprises a lead-in ramp surface adapted to lead said fastener laterally into a position between said contact surfaces.

2. The driving device of claim 1, wherein said lateral directions of motion of said centering elements lie in respective planes tangential to a circle centered on a lengthwise axis of said fastener.

3. The driving device of claim 1, wherein said centering elements are tiltably connected to said mounting body at respective tilting axes, said elastic element comprises a spring biasing the tilting motion of said centering elements, and said contact surfaces are respectively oriented substantially perpendicularly to said tilting axes.

4. The driving device of claim 1, wherein said centering elements comprise respective contact jaws on which said contact surfaces are provided, and said contact jaws further comprise respective head contact ramp surfaces adapted to be contacted by a head of said fastener.

5. A fastener driving device comprising a fastener driving bit extending along a driving axis of said device, a mounting body arranged around said driving axis, and a plurality of centering elements having respective contact surfaces adapted to contact said fastener, wherein said centering elements are movably connected to said mounting body so that said contact surfaces extend along and are movable in respective planes tangential to a circle centered at said driving axis, wherein said centering elements are connected to said mounting body by a connection such that said centering elements are respectively rigidly held against motion in directions extending radially from said driving axis and perpendicularly to said planes tangential to said circle.

6. The fastener driving device of claim 5, wherein said centering elements are tiltably connected to said mounting body at respective tilting axes, and said contact surfaces are respectively oriented substantially perpendicularly to said tilting axes.

7. The fastener driving device of claim 5, wherein said circle is adapted to correspond substantially with a shaft circumference of said fastener, and wherein said centering elements are adjustably connected to said mounting body to allow a diameter of said circle to be adjusted.

8. A driving device for a fastener, comprising a housing, a mounting body connected to said housing, a plurality of threaded bolts arranged in a plurality of threaded holes in said mounting body, a plurality of centering elements tiltably arranged on said threaded bolts and thereby connected to said mounting body so as to be tiltable relative to said fastener in respective lateral directions of motion and so that a respective position of each one of said centering elements is adjustable in a respective direction perpendicular to said respective lateral direction of motion of each one of said centering elements, and at least one elastic element arranged to urge said centering elements toward respective positions to contact said fastener, wherein each respective one of said centering elements comprises a respective contact surface adapted to contact said fastener and arranged substantially parallel to said respective lateral direction of motion of said respective centering element.

9. A driving device for a fastener, comprising a housing, a mounting body connected to said housing, three centering elements connected to said mounting body to be movable relative to said fastener in three respective lateral directions, and at least one elastic element urging said centering elements toward respective positions to contact said fastener, wherein said centering elements comprise respective contact surfaces that are adapted to contact said fastener and that are arranged along edges of an equilateral triangle and respectively substantially parallel to said three lateral directions.

10. A driving device for a fastener, comprising a housing, a mounting body connected to said housing, a total of two centering elements tiltably connected to said mounting body to be respectively tiltable relative to said fastener in respective tilting planes oriented perpendicularly to each other, and at least one elastic element urging said centering elements toward respective positions to contact said fastener, wherein each respective one of said centering elements comprises a respective contact surface adapted to contact said fastener and arranged substantially parallel to said respective tilting plane of said respective centering element, wherein a first one of said centering elements comprises a first contact jaw having a first one of said contact surfaces, a first ramp surface and a pocket recess, wherein a second one of said centering elements comprises a second contact jaw having a second one of said contact surfaces, a second ramp surface, and a shape adapted to selectively reach into said pocket recess, and wherein said first ramp surface is arranged closer to said housing than is said second ramp surface.

11. A driving device for a screw fastener having a threading, said device comprising a housing, a mounting body connected to said housing, a plurality of centering elements connected to said mounting body to be movable relative to said fastener in respective plural lateral directions, and at least one elastic element urging said centering elements toward respective positions to contact said screw fastener, wherein said centering elements comprise respective contact surfaces that are adapted to contact said fastener and that are arranged respectively substantially parallel to said lateral directions, and wherein at least one of said centering elements comprises a rib that is adapted to engage said threading of said screw fastener and that is arranged protruding radially inwardly from said contact surface of said one of said centering elements.

12. The driving device of claim 11, having a total of two of said centering elements, wherein said centering elements are tiltably connected to said mounting body to be respectively tiltable in tilting planes oriented perpendicularly to each other.

13. The driving device of claim 12, wherein a first respective one of said contact surfaces of a first one of said two centering elements extends parallel to said tilting plane of said first centering element, and a second respective one of said contact surfaces of a second one of said two centering elements extends parallel to said tilting plane of said second centering element.

14. The driving device of claim 13, wherein said first centering element has a total of one said contact surface and said second centering element has two of said contact surfaces that are parallel to each other.

15. The driving device of claim 12, wherein a first one of said centering elements comprises a first contact jaw having a pocket recess and having a tilt-actuating surface adapted to be contacted by a head of said screw fastener to cause said first centering element to tilt in a respective first one of said tilting planes, wherein a second one of said centering elements comprises a second contact jaw having a shape adapted to selectively reach into said pocket recess and having a second tilt-actuating surface adapted to be contacted by said head of said screw fastener to cause said second centering element to tilt in a respective second one of said tilting planes, and wherein said first tilt-actuating surface is arranged closer to said housing than is said second tilt-actuating surface.

16. The driving device of claim 11, further comprising a driving bit adapted to drive said fastener and extending along a driving axis of said device, wherein said mounting body is arranged outwardly around said driving bit, and said mounting body is axially movable relative to said housing in a direction parallel to said driving axis.

17. The driving device of claim 11, wherein said lateral directions of motion of said centering elements lie in respective planes tangential to a circle centered on a lengthwise axis of said fastener.

18. The driving device of claim 11, wherein said centering elements are tiltably connected to said mounting body at respective tilting axes, said elastic element comprises a spring biasing the tilting motion of said centering elements, and said contact surfaces are respectively oriented substantially perpendicularly to said tilting axes.

19. The driving device of claim 11, wherein said centering elements comprise respective contact jaws on which said contact surfaces are provided, and said contact jaws further comprise respective ramp surfaces adapted to be contacted by a head of said fastener.

20. The driving device of claim 11, wherein each of said centering elements is connected to said mounting body in an adjustable manner so that a position of said centering element is adjustable in a direction perpendicular to said lateral direction of motion of said centering element.

21. The driving device of claim 11, wherein said rib extends substantially perpendicularly to a driving axis of said device.

22. A driving device for a fastener, comprising a housing, a mounting body connected to said housing and having slots therein extending in respective directions tangential to a circle centered at a driving axis of said device, a plurality of centering elements connected to said mounting body by being respectively slidably arranged in said slots so as to be respectively slidable along said directions tangential to said circle and relative to said fastener, and at least one elastic element urging said centering elements toward respective positions to contact said fastener, wherein said centering elements comprise respective contact surfaces that are adapted to contact said fastener and that are respectively arranged substantially parallel to said directions tangential to said circle.

23. A fastener driving device comprising a fastener driving bit extending along a driving axis of said device, a mounting body arranged around said driving axis, and a plurality of centering elements having respective contact surfaces adapted to contact said fastener, wherein said centering elements are movably connected to said mounting body so that said contact surfaces extend along and are movable in respective planes tangential to a circle centered at said driving axis, wherein said circle is adapted to correspond substantially with a shaft circumference of said fastener, and wherein said centering elements are adjustably connected to said mounting body to allow a diameter of said circle to be adjusted.

* * * * *

UNITED STATES PATENT AND TRADEMARK OFFICE
CERTIFICATE OF CORRECTION

PATENT NO. : 5,671,642
DATED : September 30, 1997
INVENTOR(S) : Haas

It is certified that error appears in the above-identified patent and that said Letters Patent is hereby corrected as shown below.

Col. 3, line 40, replace "driving" by --a driving-- ;
line 54, replace "workpiece B" by --workpiece 5-- ;

Col. 4, line 49, after "fastener" insert --2-- ;
line 51, after "FIG. 2" insert --,-- ;

Col. 6, line 64, replace "head contact" by --head-contact-- .

Signed and Sealed this

Twenty-third Day of December, 1997

*Attest:*

*Attesting Officer*

BRUCE LEHMAN

*Commissioner of Patents and Trademarks*